United States Patent [19]

Rhodes

[11] 4,439,305

[45] Mar. 27, 1984

[54] PROCESS FOR PYROLYSIS OF CARBONOUS MATERIALS

[75] Inventor: Richard P. Rhodes, Westfield, N.J.

[73] Assignee: Exxon Research and Engineering Co., Florham Park, N.J.

[21] Appl. No.: 401,002

[22] Filed: Jul. 22, 1982

Related U.S. Application Data

[63] Continuation-in-part of Ser. No. 220,684, Dec. 20, 1980, abandoned.

[51] Int. Cl.[3] ..... C10G 1/00; C10G 1/06

[52] U.S. Cl. ..... 208/10; 208/8 R; 208/11 R

[58] Field of Search ..... 208/8 R, 11 R, 10

[56] References Cited

U.S. PATENT DOCUMENTS

| | | | |
|---|---|---|---|
| 1,919,108 | 7/1933 | Harrison et al. | 208/10 |
| 2,006,996 | 7/1935 | Krauch et al. | 208/10 |
| 3,502,564 | 3/1970 | Hodgson | 208/10 |
| 3,532,617 | 10/1970 | Hodgson | 208/10 |
| 3,663,452 | 6/1972 | Kiousky et al. | 208/10 |
| 3,775,286 | 11/1973 | Mukherjee et al. | 208/10 |
| 4,019,975 | 4/1977 | Urquhart | 208/10 |
| 4,136,013 | 1/1979 | Moll et al. | 208/10 |
| 4,257,873 | 3/1981 | Zieke et al. | 208/10 |

FOREIGN PATENT DOCUMENTS

| | | | |
|---|---|---|---|
| 23639 | 7/1935 | Australia | 208/10 |
| 197808 | 3/1978 | Fed. Rep. of Germany | 208/10 |

OTHER PUBLICATIONS

James L. Johnson, "The Use of Catalysts in Coal Gasification", Catal. Rev. Sci. Eng., 14(1), 131–152, (1976).

Matsuura, Bodily and Wiser, "Active Sites for Coal Hydrogenation", ACS Div. Fuel Chem. Prepr., 19/1, 157–162, (1974).

*Primary Examiner*—Delbert E. Gantz
*Assistant Examiner*—Helane E. Maull
*Attorney, Agent, or Firm*—Henry E. Naylor

[57] ABSTRACT

Carbonous materials such as subbituminous coal, oil-shale, lignite and peat are converted to liquid and gaseous products by (a) impregnating the material with a water soluble salt of a metal selected from the group consisting of iron and zinc, (b) precipitating said metal in as its oxide or a form which can be readily converted to its oxide, and (c) pyrolyzing the treated material at a temperature from about 400° C. to 600° C. at short gas residence times and long solids residence times.

24 Claims, No Drawings

PROCESS FOR PYROLYSIS OF CARBONOUS MATERIALS

CROSS-REFERENCE TO RELATED APPLICATIONS

This application is a continuation-in-part of Ser. No. 220,684, filed Dec. 20, 1980 now abandoned.

BACKGROUND OF THE INVENTION

The present invention relates to an improved process for the pyrolysis of carbonous materials, such as coal, to produce liquid and gaseous products, by the use of iron and/or zinc soluble salts prior to pyrolysis.

Coal, once the leading source of energy in the United States, is beginning to play a more important role in the nation's energy future. The primary reason for the growing importance of coal is the rapid depletion of known petroleum and natural gas reserves. These known reserves are being depleted at a rate considerably faster than the rate of discovering new reserves. As the era of petroleum growth draws to a close, the world's commercial energy mix will have to change. Transition energy sources will be needed as a bridge between petroleum and the potentially unlimited energy sources of the future; such sources being, for example, solar power and nuclear fusion. Owing to their great abundance, coal and oil shale are perceived as the keystones of such a bridge. Consequently, much work is presently in progress to provide economical ways of converting these resources to valuable liquid and gaseous products. Coal liquefaction and pyrolysis processes in which coal, with or without a diluent, is subjected to elevated temperatures and pressures to convert solid coal to normally liquid hydrocarbonaceous products, are well known.

Pyrolysis of coal to yield liquids and char is an area of technology which has the potential of leading the way to a successful national synfuels program. The major limitations of present coal pyrolysis technology are the low quality of simple pyrolysis liquids combined with high sulfur content. Even when a coal in relatively low sulfur content is employed to reduce the need for hydrotreating, the product is generally low in yield and has stability problems.

By the practice of the present invention, pyrolysis in the presence of hydrogen is advantageously combined under certain conditions, to give increased yields and more stable liquid products than those acquired by use of pyrolysis processes conventionally known.

SUMMARY OF THE INVENTION

In accordance with the present invention, there is provided a process for converting carbonous materials selected from the group consisting of subbituminous coal, oil-shale, lignite and peat, to liquid and gaseous products, said process comprising: (a) impregnating the carbonous material with one or more water soluble salts of a metal selected from the group consisting of iron and zinc; (b) treating the impregnated material in such a way as to precipitate, into the structure of the material, the metal of the soluble salt as its oxide or in a form which can be readily converted to its oxide by decomposition; and (c) pyrolyzing the treated impregnated material in the presence of hydrogen, at a temperature from about 400° C. to about 700° C., and at gas residence times of less than about 30 seconds and solids residence times of from about 5 to 100 minutes.

In preferred embodiments of the present invention subbituminous coal or oil-shale is impregnated with iron sulfate, treated with sodium carbonate, and pyrolyzed at a temperature of about 550° C.

DETAILED DESCRIPTION OF THE INVENTION

Any type of coal or oil shale may be treated according to the present invention, although for coal it is preferred to treat only the lower rank coals such as, subbituminous coal, lignite, and peat; of course, other similar solid carbonous materials may also be employed. Such coals usually have the following character: carbon content ranging from about 55 to 88 wt.%, hydrogen content ranging from about 3.8 to 6.2 wt.%, oxygen content ranging from about 2.6 to 33 wt.% (MAF basis), and a H/C ratio from about 0.3 to 1.1. In addition, oil shales, particularly those with high aromatic content, can be treated in accordance with the present invention.

It is preferred that the carbonous material have as high a surface area as possible; although, it is not economically justifiable to pulverize it to a very fine powder. Consequently, it is desirable to expose as much of the material's surface area as possible without losing material as dust or fines or as the economics of grinding or process equipment may dictate. Generally, for purposes of this invention, the material will be ground to a finely divided state and will contain a majority of particles less than about 4 mesh, U.S. Sieve Size. The coal may be dried by conventional drying techniques, for example, heating to a temperature of about 100° C. to 110° C.

The carbonous material, after grinding, is impregnated with a water soluble salt of a metal selected from the group consisting of iron and zinc by forming a slurry of coal and salt solution. Non-limiting examples of water soluble salts suitable for use herein include iron chloride, iron sulfate, iron nitrate, zinc chloride and zinc sulfate. More preferred is iron sulfate.

The salt solution is prepared by dissolving enough of the salt in water to result in at least a 0.01 M solution. Preferably a 0.1 M solution is employed. It is desirable to dissolve the salt in enough polar solvent, preferably water so as to have about the same weight of water as the weight of carbonous material. The salt solution and carbonous material are slurried at a temperature from about room temperature (20° C.) to about the boiling point of the solution. Generally, about 1 part of salt solution by weight is employed for each part of carbonous material by weight.

After the carbonous material has been slurried with the salt solution for an effective amount of time, it is treated in such a way as to precipitate, into the structure of the carbonous material, the metal of the soluble salt employed, in a well dispersed form as its oxide or in a form which can be readily converted to the oxide by decomposition. Effective amount of time, as used in this context, means at least that amount of time needed to ensure substantially total impregnation of the salt solution into the structure of the carbonous material. This amount of time is primarily dependent on the moisture content of the carbonous material. For example, impregnation of dry coal is achieved in a matter of minutes whereas impregnation of wet coal may require about 24 hours owing to transfer problems of the salt into the wet coal structure.

After the carbonous material is impregnated with the water soluble salt, it is treated in such a way as to cause precipitation, into the structure of the carbonous material, of the metal of the soluble salt used for impregnation. The precipitated metal will most likely be in a well dispersed form, preferably as its oxide, or in a form which can be readily converted to its oxide by decomposition. Non-limiting examples of such methods which can be employed herein, to cause precipitation, include: (a) raising the pH of the slurry to an effective pH to cause precipitation of the metal as a hydroxide or hydrated oxide; (b) introducing an anion into the slurry in form of another soluble salt which will produce the oxide of the metal or which will produce a form which can readily be converted to its oxide by decomposition, for example at the pyrolysis conditions employed herein.

Non-limiting examples of cations of which this other anion producing soluble salt is comprised include sodium, ammonium and potassium. Considerations which sould be kept in mind when choosing such other salt as well as any other agent used to cause precipitation: (a) not adversely affect the pyrolysis products or their evolution and recovery, (b) be economically feasible, and (c) be non-toxic.

If the method used for precipitating the metal of the impregnating salt employed herein is to raise the pH, an appropriate base is introduced into the slurry. Non-limiting examples of bases suitable for being employed herein include ammonia, a caustic solution, and an organic base. The pH to which the impregnated carbonous material slurry would have to be raised to affect precipitation would vary depending upon the solubility product of the salts employed. Generally, a pH in excess of about 11 will precipitate most salts.

If the method used to precipitate the metal of the impregnating salt employed is to introduce an anion into the slurry, the anion chosen is one which will produce an insoluble form of the metal of the soluble salt employed herein for impregnating. Such an insoluble form should be one which is its oxide already or one which can be readily decomposed, under the pyrolysis conditions employed herein, to its oxide. Non-limiting examples of anions suitable for such purposes include carbonates, bicarbonates, hydroxides, etc.

After treating, so as to precipitate the metal in a well-dispersed form, it is preferred to dry the treated carbonous material. Any conventional drying means may be employed.

The treated and preferably dried carbonous material is then subjected to pyrolysis at temperatures from about 400° C. to about 700° C., preferably from about 450° C. to 600° C. The pyrolysis is performed in the presence of hydrogen, generally at hydrogen pressures from about 500 to 2500 psi. Any excess hydrogen, of course, will be recycled. Furthermore, the pyrolysis is performed at relatively short gas and long solids residence times. That is, the gas residence time should be less than about 30 seconds, preferably less than 10 seconds and the solids residence times should be from about 5 to 100 minutes, preferably from about 10 to 30 minutes. By choosing the proper residence time, substantially maximum conversion of carbonous material to liquids and gases are achieved and undesirable secondary reactions are minimized. Such undesirable secondary reactions include irreversible condensation reactions of molecules which will lead to char.

Non-limiting examples of reactors suitable for use herein include fixed and fluid bed. The primary constraint on the reactor employed is to minimize contact with the solid phase with hydrogen at reaction temperatures.

The following examples serve to more fully describe the manner of practicing the above-described invention, as well as to set forth the best modes contemplated for carrying out various aspects of the invention. It is understood that these examples in no way serve to limit the true scope of this invention, but rather, are presented for illustrative purposes.

EXAMPLE 1

200 g of Rawhide subbituminous coal was washed with 1.0% HCl solutions until no calcium appeared in the wash. This also improved the wetability of the coal. The coal was then washed with distilled water until the wash was neutral. The washed coal was then dried in a vacuum oven at 105° C. for three hours after which it was treated with an equal weight of a 10% by weight solution of zinc chloride. An equal weight, based on the weight of dry coal, of a 10% by weight solution of sodium carbonate was added. The mixture was allowed to stand overnight at room temperature after which it was dried in a vacuum oven at 105° C. for three hours.

150 g of this dried and treated coal was pyrolyzed in a fixed bed type reactor, by heating it at a rate of 6° C./min. to 600° C. and holding it at about that temperature for 20 minutes. The fixed bed was an annular configuration having the dimensions of 4" ID×4½" OD×6" deep, and has a hydrogen flow rate of 2 standard cu. ft/min.

The total liquid product collected was 39.3 wt.% of the dry coal.

COMPARATIVE EXAMPLE A

The procedure of Example 1 was followed except the coal was not treated with salt solutions. After pyrolysis the untreated coal produced a liquid product of 30.2 wt.% based on the weight of the dry coal.

These examples illustrate the advantages of employing the present invention to obtain maximum amounts of liquid product from coal by pyrolysis.

EXAMPLE 2

The procedure of Example 1 above was followed except ferrous ammonium sulfate was substituted for zinc chloride and 1% by weight solution of sodium carbonate was employed to precipitate ferrous hydroxide into the coal structure. The iron content of the impregnating solution was 0.14 wt.%.

Pyrolysis was carried out by heating the sample, under 400 psi hydrogen pressure, to 300° C. rapidly then utilizing a heating rate of 100° C./30 min., to 500° C.

The total conversion of dry coal to volatile (liquid and gas) products was 52.8 wt.%.

COMPARATIVE EXAMPLE B

The procedure of Example 2 above was followed except the coal was not treated with the salt solutions before pyrolysis. After pyrolysis, it was found that 43.0 wt.% based on the weight of the dry coal, had been converted to volatile products.

COMPARATIVE EXAMPLE C

A 5 g sample of coal together with 7.37 g of paraffin oil vehicle were charged into a small shaken autoclave.

The autoclave was closed and pressurized with hydrogen gas, at room temperature, to a pressure of 850 psi. The autoclave was heated to a temperature of 400° C. and maintained, with shaking, at that temperature for 3 hours. The internal pressure inside the autoclave at 400° C. was 2410 psi. At the end of the reaction period, the autoclave was quickly cooled to room temperature and its contents were rinsed with benzene into a Soxhlet apparatus. The contents from the reactor was extracted for 3 hours after which organic benzene insolubles (OBI) were calculated according to the expression:

$$\text{Conversion} = \frac{d.a.f.\ \text{coal} - OBI}{d.a.f\ \text{coal}} \times 100$$

It was found that the degree of conversion of the coal sample charged into the autoclave was 36%—that is, 64% of the coal sample remained as benzene insolubles.

COMPARATIVE EXAMPLE D

Another experiment was carried out under conditions identical to the conditions set forth in Comparative Example C above except the coal sample was first pretreated in accordance with the following procedure.

Pretreatment

The sample of coal was washed with 1.0% HCl solutions until no calcium appeared in the wash. The coal was then washed with distilled water until the wash was neutral. The washed coal was then dried in a vacuum oven at 105° C. for three hours after which it was treated with an equal weight of a 10% by weight solution of zinc chloride. An equal weight, based on the weight of dry coal, of a 10% by weight solution of sodium carbonate was added. The mixture was allowed to stand overnight at room temperature after which it was dried in a vacuum oven at 105° C. for three hours. This treated coal was found to contain about 10% zinc carbonate by weight on dry coal.

After the pretreated coal was reacted in accordance with the procedure set forth in Comparative Example C above, it was found that conversion of the sample of coal charged into the autoclave was 38%—that is, 62% of the coal sample remained as benzene insolubles.

Comparative Examples C and D demonstrate the importance of short gas residence times in the practice of the present invention. These two comparative examples follow the teaching of U.S. Pat. No. 3,775,286 to Mukherjee et al wherein batch type reactions are conducted in which long gas residence times are employed. As can be seen from the conversions conducted in these two comparative examples, a pretreatment with zinc chloride is unable to increase the conversion of coal over the base process set forth in Comparative Example C because relatively long gas residence times are employed.

What is claimed is:

1. A method for converting a carbonous material selected from the group consisting of subbituminous coal, oil-shale, lignite, and peat, to liquid and gaseous products, the method consisting essentially of:
   (a) impregnating the carbonous material with one or more soluble iron salts;
   (b) treating the impregnated carbonous material in such a way as to precipitate, into the structure of the carbonous material, said metal as its oxide or in a form which can be readily converted to its oxide under the pyrolysis conditions of step (c) below; and
   (c) pyrolyzing the treated carbonous material at a temperature from about 400° C. to about 700° C., at gas residence times of less than about 30 seconds and solids residence times from about 5 to 100 minutes, wherein a reducing gas consisting essentially of hydrogen is introduced during pyrolysis.

2. The method of claim 1 wherein the carbonous material is subbituminous coal.

3. The method of claim 1 or 2 wherein the soluble salt is selected from the group consisting of iron chloride, iron sulfate, and iron nitrate.

4. The method of claim 3 wherein the soluble salt is iron sulfate.

5. The method of claim 1 or 2 wherein the carbonous material is first dried before impregnation.

6. The method of claim 4 wherein the carbonous material is first dried before impregnation.

7. The method of claim 1 or 2 wherein the pH of the impregnated coal is raised to cause precipitation of metal of the water soluble salt.

8. The method of claim 6 wherein the pH of the impregnated coal is raised to cause precipitation of the metal of the water soluble salt.

9. The method of claim 1 or 2 wherein the metal of the soluble salt is precipitated by treatment with one or more other salts selected from the group consisting of the carbonates, bicarbonates, and hydroxides of sodium, ammonium and potassium.

10. The method of claim 8 wherein the metal of the soluble salt is precipitated by treatment with one or more salts selected from the group consisting of sodium, ammonium and potassium.

11. The method of claim 1 or 2 wherein pyrolysis is conducted at a temperature from about 450° C. to 600° C., at hydrogen pressures of 500 to 2500 psi, at gas residence times of less than about 10 seconds, and at solids residence times from about 10 to 30 minutes.

12. The method of claim 10 wherein pyrolysis is conducted at a temperature from about 450° C. to 600° C., at hydrogen pressures of 500 to 2500 psi, at a gas residence times of less than about 10 seconds, and at solids residence times from about 10 to 30 minutes.

13. A method for converting a carbonous material selected from the group consisting of subbituminous coal, oil-shale, lignite, and peat, to liquid and gaseous products, the method comprising:
   (a) impregnating the carbonous material with one or more water soluble zinc salts;
   (b) treating the impregnated carbonous material in such a way as to precipitate, into the structure of the carbonous material, said metal as its oxide or in a form which can be readily converted to its oxide under the pyrolysis conditions of step (c) below; and
   (c) pyrolyzing the treated carbonous material at a temperature from about 400° C. to about 700° C., at gas residence times of less than about 30 seconds and solids residence times from about 5 to 100 minutes, wherein a reducing gas consisting essentially of hydrogen is introduced during pyrolysis.

14. The method of claim 13 wherein the carbonous material is subbituminous coal.

15. The method of claim 13 wherein the soluble salt is selected from the group consisting of zinc chloride and zinc sulfate.

16. The method of claim 15 wherein the soluble salt is zinc sulfate.

17. The method of claim 13 wherein the carbonous material is first dried before impregnation.

18. The method of claim 16 wherein the carbonous material is first dried before impregnation.

19. The method of claim 13 wherein the pH of the impregnated coal is raised to cause precipitation of metal of the water soluble salt.

20. The method of claim 18 wherein the pH of the impregnated coal is raised to cause precipitation of the metal of the water soluble salt.

21. The method of claim 13 wherein the metal of the soluble salt is precipitated by treatment with one or more salts selected from the group consisting of the carbonates, bicarbonates, and hydroxides of sodium, ammonium and potassium.

22. The method of claim 20 wherein the metal of the soluble salt is precipitated by treatment with one or more salts selected from the group consisting of sodium, ammonium and potassium.

23. The method of claim 13 wherein pyrolysis is conducted at a temperature from about 450° C. to 600° C., at hydrogen pressures of 500 to 2500 psi, at gas residence times of less than about 10 seconds, and at solids residence times from about 10 to 30 minutes.

24. The method of claim 22 wherein pyrolysis is conducted at a temperature from about 450° C. to 600° C., at hydrogen pressures of 500 to 2500 psi, at a gas residence times of less than about 10 seconds, and at solids residence times from about 10 to 30 minutes.

* * * * *